US006017296A

United States Patent [19]

Tang et al.

[11] Patent Number: 6,017,296

[45] Date of Patent: Jan. 25, 2000

[54] EXERCISE WHEEL

[76] Inventors: Jack Tang, 1F, No. 7, Alley 27, Lane 247, Chung Cheng Road, Hsin Tien City, Taipei Hsien, Taiwan; Hui-Nan Yu, No. 14, Lane 252, Chien Kuo Road, Tao Yuan City, Taiwan

[21] Appl. No.: 09/347,851

[22] Filed: Jul. 9, 1999

[51] Int. Cl.[7] ..... A63B 21/22

[52] U.S. Cl. ..... 482/132; 482/127; 482/907

[58] Field of Search ..... 482/132, 127, 482/907, 116, 126, 121

[56] References Cited

U.S. PATENT DOCUMENTS

| | | | |
|---|---|---|---|
| 1,824,920 | 9/1931 | Novak | 482/132 |
| 2,821,344 | 1/1958 | Barbeau | 482/132 |
| 3,403,906 | 10/1968 | Borzenski | 482/132 |
| 3,938,803 | 2/1976 | Wilmoth et al. | 482/132 |
| 4,892,305 | 1/1990 | Lynch | 482/132 |
| 5,433,685 | 7/1995 | Winslow et al. | 482/96 |

*Primary Examiner*—Jerome Donnelly
*Attorney, Agent, or Firm*—Browdy and Neimark

[57] ABSTRACT

An exercise wheel comprises a housing provided therein with a receiving compartment, a grip rod which is put through the housing such that both longitudinal ends thereof are left out in the outerside of the housing, a main wheel rotatably mounted on the grip rod such that the main wheel is located in the receiving compartment of the housing, two auxiliary wheel sets pivoted in the housing such that they are linked with the main wheel, and at least one elastic recovery device disposed between the main wheel and the housing for providing the main wheel with a recovery force enabling the main wheel to return to its original angular position.

11 Claims, 5 Drawing Sheets

EXERCISE WHEEL

FIELD OF THE INVENTION

The present invention relates generally to an exercise device, and more particularly to an exercise wheel.

BACKGROUND OF THE INVENTION

As shown in FIG. 1, an exercise wheel of the prior art comprises a hollow shaft 11 which is provided at one end thereof with a long slot 12 of a length and extending toward the midsection thereof, a volute spring 13 provided in the center thereof with a locating piece 131 which is retained in the long slot 12, and two rollers 14 which are provided at the center thereof with a round hole 15. Both ends of the shaft 11 are fitted into the round holes 15 of the two rollers 14. The two rollers 14 are joined together in the middle of the shaft 11 such that the volute spring 13 is confined in the rollers 14. The two rollers 14 are provided in the peripheral edges of the round holes 15 thereof with a hollow guide pillar 16 for fastening a bolt 17. One of the two hollow pillar 16 is shorter than other so as to enable the bolt 17 to be exposed to facilitate the connecting of the locating piece 132 of the outer end of the volute spring 13. In operation, the user of the exercise wheel stoops in such a manner that his or her hands hold both ends of the shaft 11 to push the rollers forward on a surface. As the rollers are pushed to roll, the volute spring 13 is compressed to store the elastic recovery force.

Such a prior art exercise wheel as described above is defective in design in that the rollers can not be rolled stably on the surface by both hands holding both ends of the hollow shaft in light of the center of gravity tending to deflect. In addition, the elastic recovery force provided by the volute spring is inadequate.

SUMMARY OF THE INVENTION

The primary objective of the present invention is to provide an exercise wheel which can be operated with stability.

It is another objective of the present invention to provide an exercise wheel capable of providing an user thereof with an adequate elastic recovery force.

In keeping with the principle of the present invention, the foregoing objectives of the present invention are attained by an improved exercise wheel comprising a housing provided therein with a receiving compartment, a grip rod which is put through the housing such that both ends of the grip rod are exposed in the outside of the housing, a main wheel mounted on the grip rod such that the main wheel is located in the receiving compartment of the housing and that the main wheel can be caused by an external force to turn on the grip rod, two auxiliary wheel sets pivoted in the housing such that they are engaged with the main wheel, and at least one elastic recovery device disposed between the main wheel and the housing for providing the main wheel with a recovery force enabling the main wheel to return to its original angular position.

The foregoing objectives, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
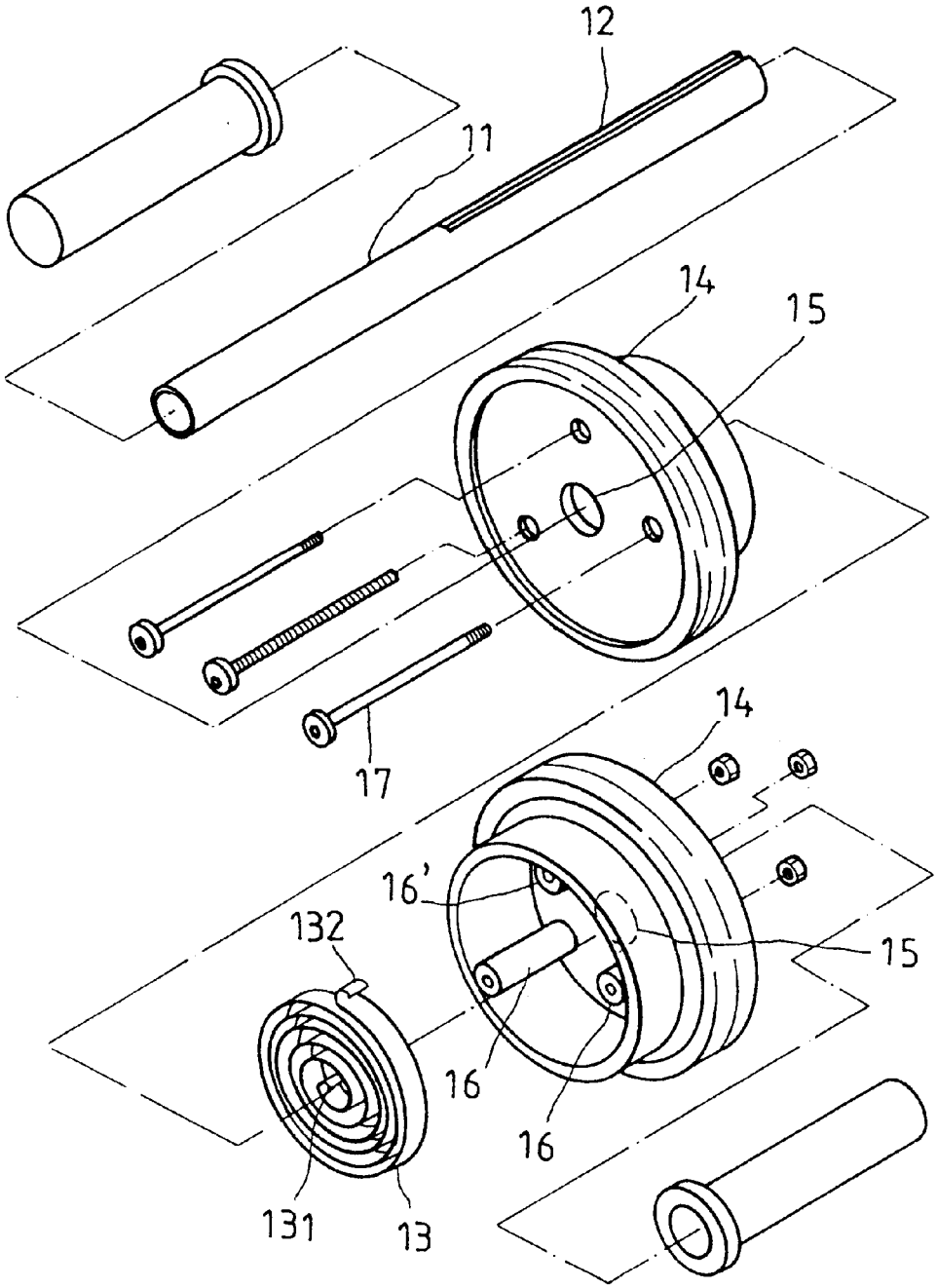
FIG 1 PRIOR ART
FIG. 1 shows an exploded view of an exercise wheel of the prior art.
Figure 2:
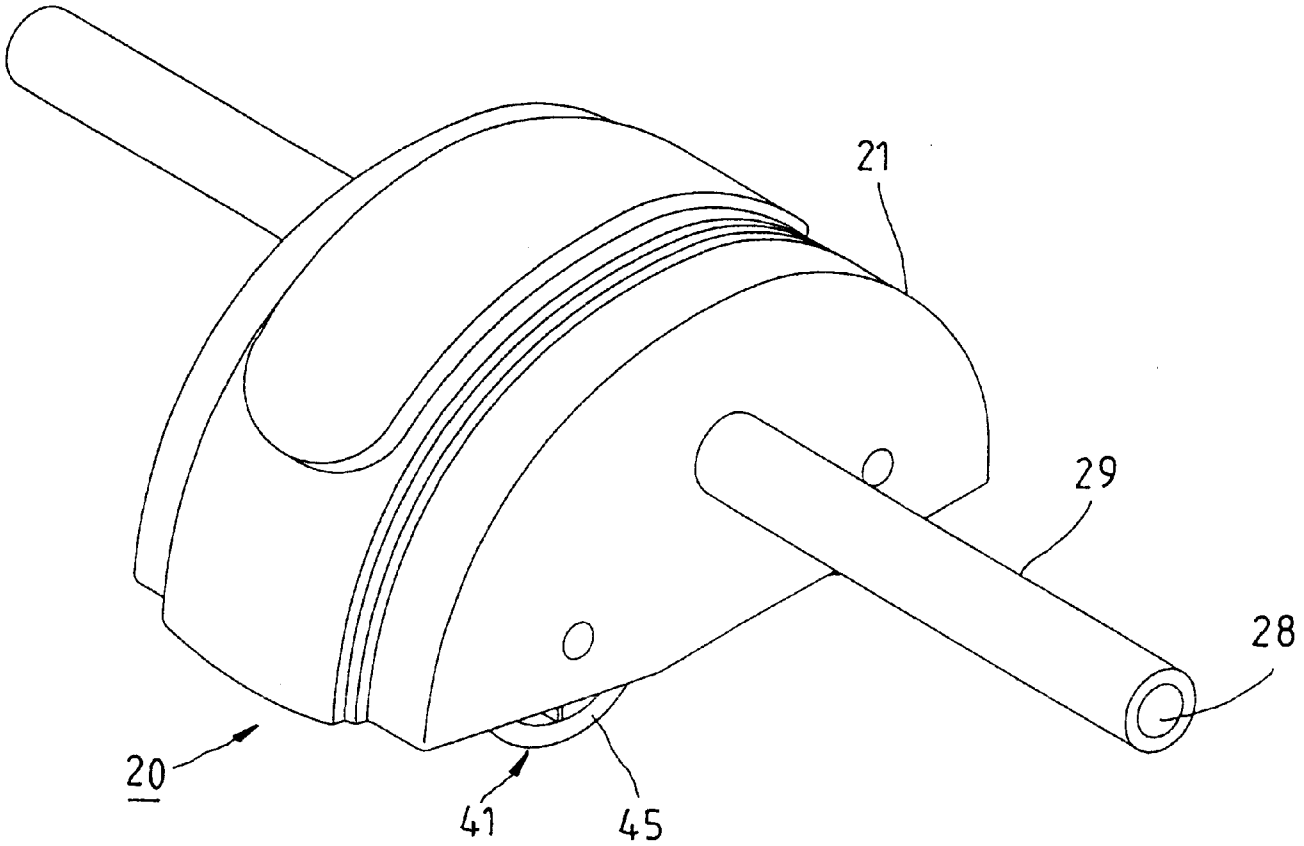
FIG. 2 shows a perspective view of the preferred embodiment of the present invention.
Figure 3:
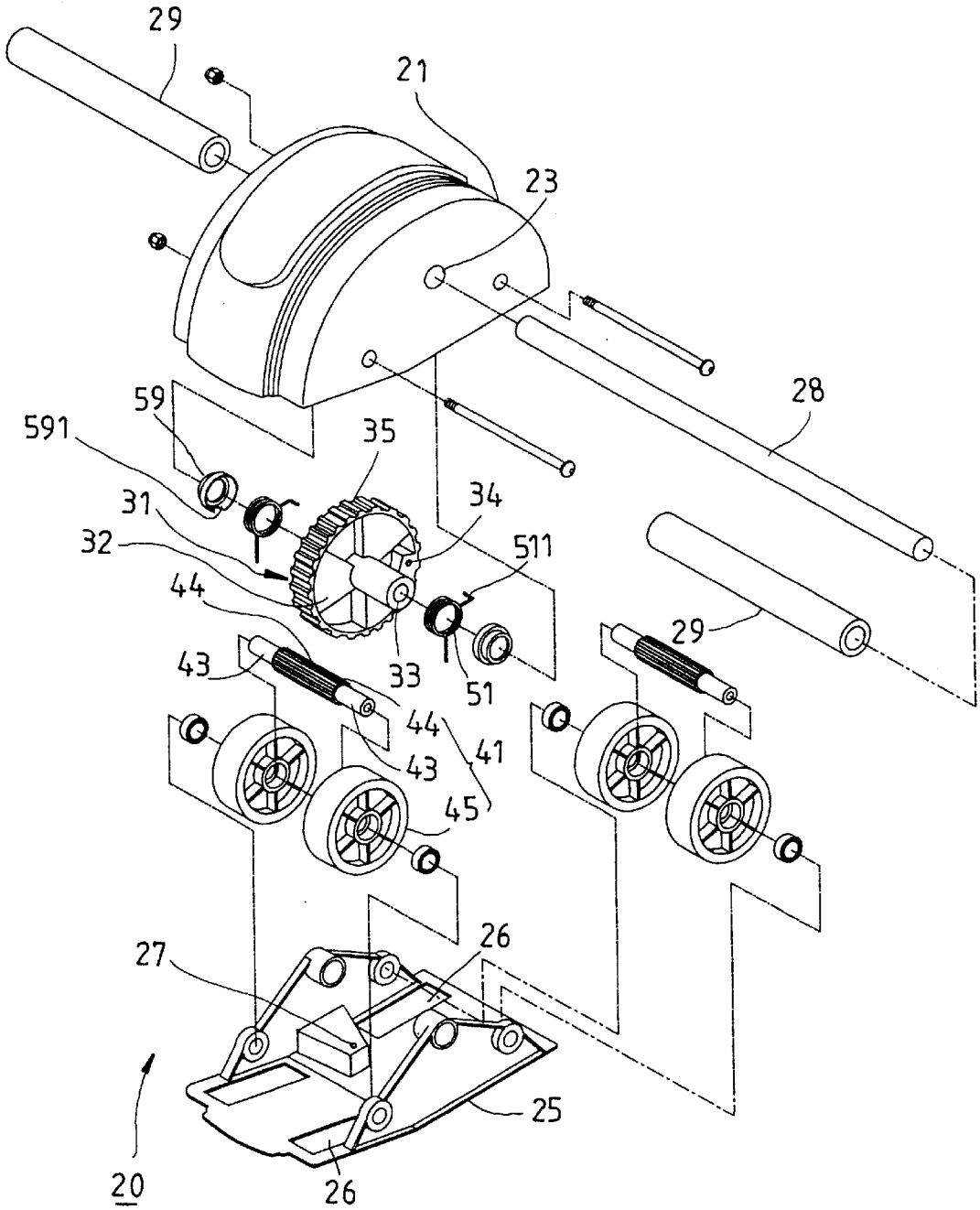
FIG. 3 shows an exploded view of the preferred embodiment of the present invention.

As shown in FIGS. 2 and 3, an exercise wheel 20 embodied in the present invention comprises a housing 21, a bottom shield 25, a grip rod 28, a main wheel 31, two auxiliary wheel sets 41, and two elastic recovery devices 51.

The housing 21 is provided therein with a receiving compartment 22 having an opening which faces downward. The housing 21 is further provided with two through holes 23 opposite in location to each other.

The bottom shield 25 is attached to the bottom of the housing 21 such that the receiving compartment 22 is shielded by the bottom shield 25. The bottom shield 25 is provided with a predetermined number of long holes 26 and is further provided in the top thereof with locating holes 27.

The grip rod 28 is put through the housing 21 such that the grip rod 28 is received in the two through holes 23 of the housing 21, and that both longitudinal ends of the grip rod 28 are left out in the outside of the housing 21. The exposed ends of the grip rod 28 have an appropriate length to facilitate the gripping of the rod 28 with both hands of a user of the exercise wheel 20 of the present invention.

The main wheel 31 has a disklike body 32 which is provided at the center thereof with an axial hole 33. The main wheel 31 is mounted on the grip rod 28 such that the grip rod 28 is put through the axial hole 33, and that the main wheel 31 is located in the receiving compartment 22. As the main wheel 31 is exerted on by an external force, the main wheel 31 is caused to turn on the grip rod 28. The body 32 of the main wheel 31 is provided in both sides thereof with an insertion hole 34, and in the peripheral edge thereof with a plurality of engagement teeth 35.

Figure 4:
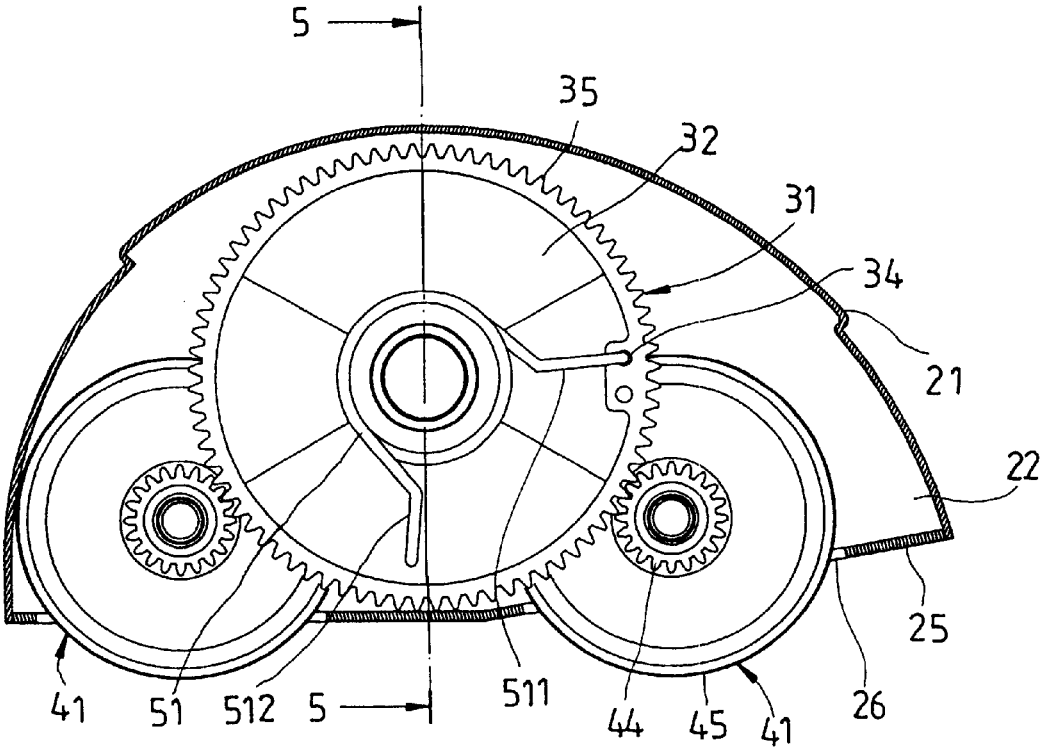
FIG. 4 is a partial side perspective view showing the connection relationships of the main wheel, the auxiliary wheel sets, and the elastic recovery device of the preferred embodiment of the present invention.

Each of the two auxiliary wheel sets 41 has a shaft 43 and two rollers 45 fastened at both ends of the shaft 43. The shaft 43 is provided in the outer surface thereof with a threaded portion 44, as shown in FIG. 4. These two auxiliary wheel sets 41 are located in the receiving compartment 22 of the housing 21 such that the shaft 43 is fastened pivotally with the wall of the housing 21, and that the threaded portion 44 of the shaft 43 is engaged with the engagement teeth 35 of the main wheel 31. The rollers 45 are exposed from the bottom of the housing via the long holes 26 such that they come in contact with a surface, and that they glide on the surface to actuate the main wheel 31 by the shaft 43.

Figure 5:
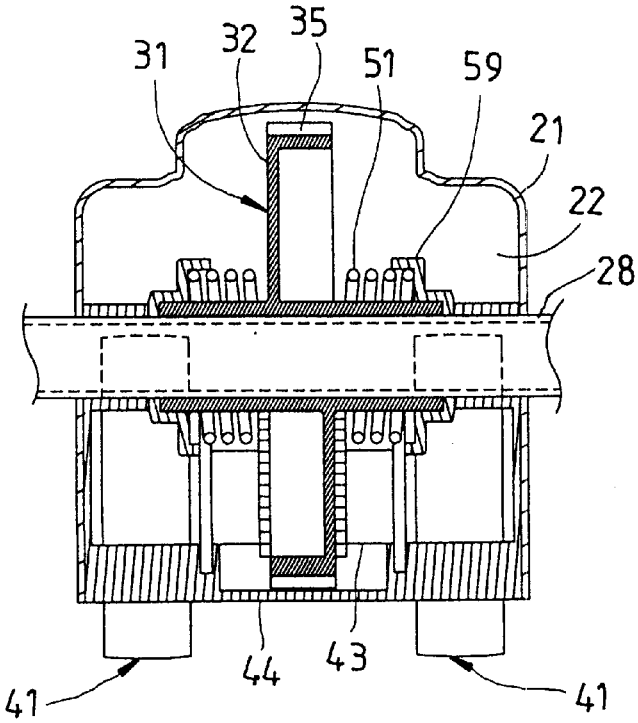
FIG. 5 shows a sectional view of a portion taken along the direction indicated by a line 5—5 as shown in FIG. 4.

The two elastic recovery devices 51 of the preferred embodiment of the present invention are torsion springs, as shown in FIG. 5. The devices 51 are located between the main wheel 31 and the housing 21 such that they are fitted over the grip rod 28, and that a first end 511 thereof is inserted into the insertion hole 34, and further that a second end 512 is inserted into the locating hole 27. When the main wheel 31 is turned, each device 51 is actuated to displace angularly to bring about the recovery elastic force. As shown in FIGS. 3 and 5, the devices 51 further comprise two position-confining members 59 of a sleevelike construction and having a cut 591. The position confining members 59 are corresponding to both ends of the main wheel 31 and are fitted over the grip rod 28 such that the cuts 591 are corresponding to the second end 512 of the devices 51. The position-confining members 59 are located between the devices 51 and the housing 21 for keeping the main wheel at the center of the housing 21.

Figure 6:
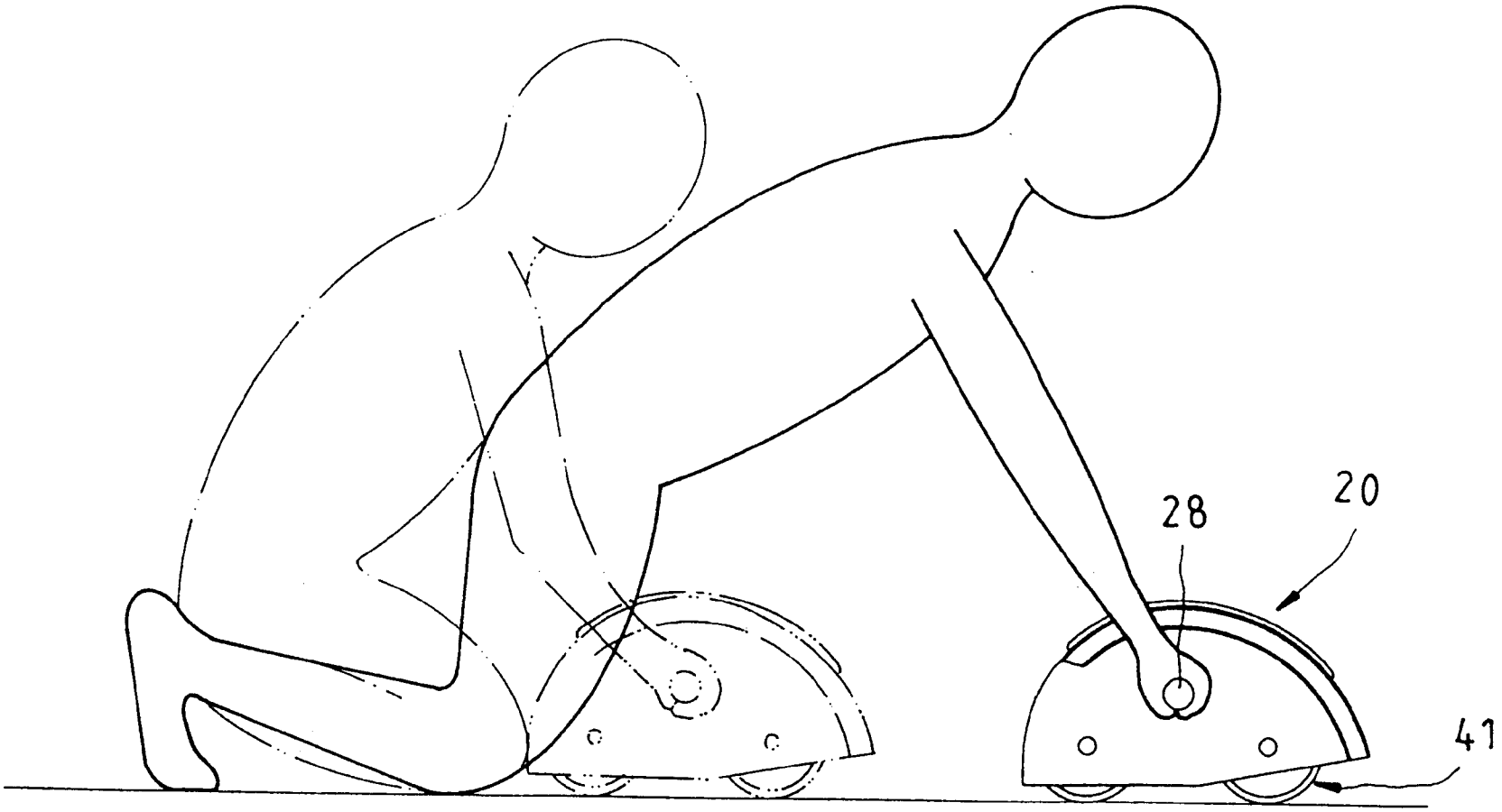
FIG. 6 shows a schematic view of the preferred embodiment of the present invention at work.

Now referring to FIG. 6, both hands of a user of the exercise wheel 20 of the present invention hold securely the grip covers 29 of the grip rod 28 before the exercise wheel 20 is placed on the surface in such a manner that rollers 45 are in contact with the surface. These step-by-step motions of the user are shown by the imaginary lines in FIG. 6. As the exercise wheel 20 is pushed forward, the rollers 45 glide forward accordingly. As a result, the main wheel 31 is actuated by the shaft 43 to turn rearward along the grip rod 28, thereby resulting in the angular displacement of the first end 511 of the devices 51. In the meantime, the second end 512 of the devices 51 is incapable of a rearward rotation in view of the second end 512 being inserted into the locating hole 27 of the bottom shield 25. The two devices 51 thus bring about the elastic energy for causing the main wheel 31 to turn in a forward direction, as shown in FIG. 6. When the user pushes forward the exercise wheel 20 and then pulls back the exercise wheel 20, the elastic energy stored in the devices 51 serves to help the user to pull back the exercise wheel 20 with ease. The purpose of the exercise is attained by repeating the steps described above.

The main wheel 31 and the auxiliary wheel sets 41 may be linked by a friction strap (not shown in the drawing). In addition, the main wheel 31 may be engaged with the rollers 45. Moreover, the auxiliary wheel set 41 may be provided with only one roller 45. The housing of the present invention may be devoid of the bottom shield, whereas both ends of the elastic recovery devices are inserted into the locating holes of the housing.

What is claimed is:

1. An exercise wheel comprising:

a housing provided in an interior thereof with a receiving compartment;

a grip rod put through said housing such that both longitudinal ends thereof are left out in the outside of said housing;

a main wheel having a disk-shaped body and mounted rotatably on said grip rod such that said main wheel is located in said receiving compartment;

two auxiliary wheel sets fastened pivotally in said interior of said housing such that said auxiliary wheel sets are engaged with said main wheel, and that said auxiliary wheel sets are in contact with a surface on which said auxiliary wheel sets glide to actuate said main wheel; and at least one elastic recovery device mounted between said main wheel and said housing for providing said main wheel with an elastic force enabling said main wheel to return to an original angular position of said main wheel in the wake of an event that said main wheel is actuated to turn.

2. The exercise wheel as defined in claim 1, wherein each of said auxiliary wheel sets has a shaft and at least one roller rotatably mounted on said shaft whereby said shaft is fastened pivotally at both longitudinal ends thereof in said receiving compartment.

3. The exercise wheel as defined in claim 2, wherein said each of said auxiliary wheel sets is linked with said main wheel in such a manner that said shaft is engaged with said main wheel.

4. The exercise wheel as defined in claim 3, wherein said shaft is provided with a threaded portion; wherein said main wheel is provided with engagement teeth; and wherein said shaft is engaged with said main wheel such that said threaded portion of said shaft is engaged with said engagement teeth of said main wheel.

5. The exercise wheel as defined in claim 3, wherein said each of said auxiliary wheel sets has two rollers whereby said two rollers are mounted on said shaft and are located in said receiving compartment.

6. The exercise wheel as defined in claim 3, wherein said main wheel is actuated by said shaft by means of friction.

7. The exercise wheel as defined in claim 2, wherein said main wheel is linked by said roller in contact with said main wheel.

8. The exercise wheel as defined in claim 2 further comprising a bottom shield fastened with a bottom of said housing such that said receiving compartment is shielded by said bottom shield, said bottom shield being provided with at least one through hole corresponding in location to said roller whereby said roller is in contact with the surface via said through hole of said bottom shield.

9. The exercise wheel as defined in claim 1, wherein said elastic recovery device is a torsion spring having a first end and a second end whereby said torsion spring is fitted over said grip rod such that said first end is fastened with said main wheel, and that said second end is fastened with said housing, and further that said torsion spring is displaced angularly at the time when said main wheel is in motion.

10. The exercise wheel as defined in claim 9, wherein said main wheel is provided with an insertion hole; wherein said housing is provided with a locating hole; and wherein said torsion spring is fastened with said main wheel and said housing such that said first end of said torsion spring is inserted into said insertion hole of said main wheel, and that said second end of said torsion spring is inserted into said locating hole of said housing.

11. The exercise wheel as defined in claim 1, wherein said grip rod is provided with two position-confining members, each being located between said main wheel and said housing for confining said main wheel in the center of said receiving compartment.

* * * * *

US006017296C1

(12) EX PARTE REEXAMINATION CERTIFICATE (4955th)

United States Patent
Tang et al.

(10) Number: US 6,017,296 C1
(45) Certificate Issued: Jun. 29, 2004

(54) EXERCISE WHEEL

(75) Inventors: Jack Tang, 1F, No. 7, Alley 27, Lane 247, Chung Cheng Road, Hsin Tien City, Taipei Hsien (TW); Hui-Nan Yu, No. 14, Lane 252, Chien Kuo Road, Tao Yuan City (TW)

(73) Assignees: Jack Tang, Taipei Tien (TW); Hui-Nan Yu, Tao Yuan (TW)

Reexamination Request:
No. 90/006,070, Jul. 25, 2001

Reexamination Certificate for:

| | |
|---|---|
| Patent No.: | **6,017,296** |
| Issued: | **Jan. 25, 2000** |
| Appl. No.: | **09/347,851** |
| Filed: | **Jul. 9, 1999** |

(51) Int. Cl.[7] ..... A63B 21/22
(52) U.S. Cl. ..... 482/132; 482/127; 482/907
(58) Field of Search ..... 482/127, 132, 482/907, 116, 126, 121

(56) References Cited

U.S. PATENT DOCUMENTS

| | | | | | |
|---|---|---|---|---|---|
| 5,232,390 | A | * | 8/1993 | Brooks | 446/72 |
| 6,017,296 | A | * | 1/2000 | Tang et al. | 482/132 |
| 6,146,318 | A | * | 11/2000 | Kuo | 482/132 |

* cited by examiner

*Primary Examiner*—Stephen R. Crow

(57) ABSTRACT

An exercise wheel comprises a housing provided therein with a receiving compartment, a grip rod which is put through the housing such that both longitudinal ends thereof are left out in the outerside of the housing, a main wheel rotatably mounted on the grip rod such that the main wheel is located in the receiving compartment of the housing, two auxiliary wheel sets pivoted in the housing such that they are linked with the main wheel, and at least one elastic recovery device disposed between the main wheel and the housing for providing the main wheel with a recovery force enabling the main wheel to return to its original angular position.

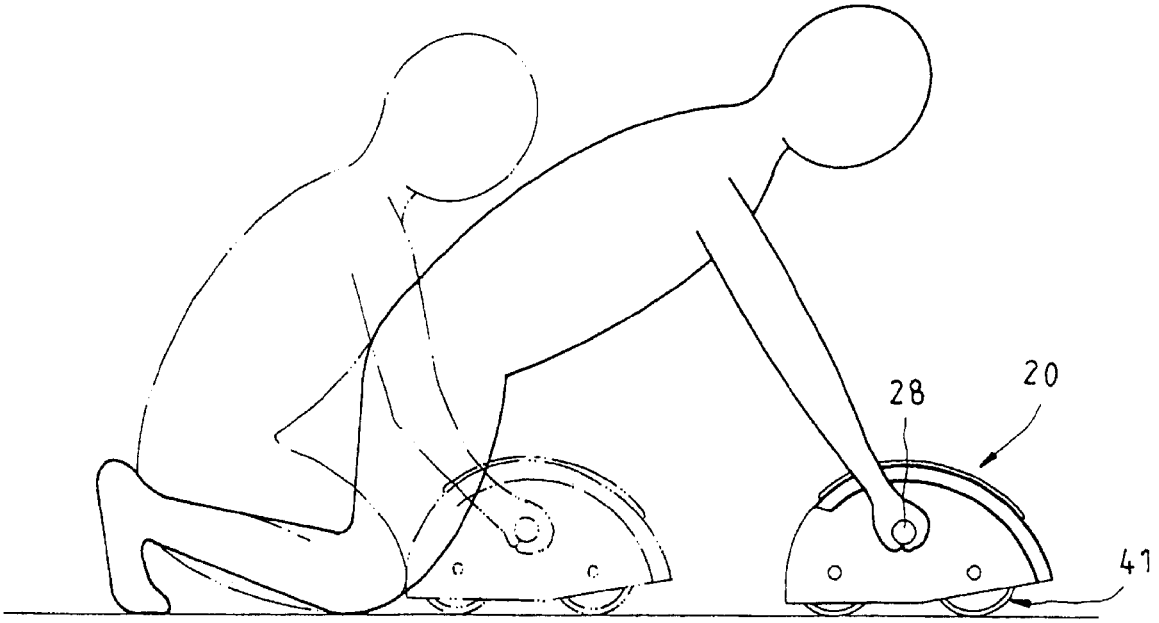

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–11 are cancelled.

* * * * *